United States Patent [19]

Lavender et al.

[11] Patent Number: 4,729,690

[45] Date of Patent: Mar. 8, 1988

[54] SELF-RIGHTING HIGHWAY MARKER SUPPORT AND METHOD FOR INSTALLING SAME

[75] Inventors: Michael R. Lavender, Chicago; Henry R. Krepel, Crystal Lake; Sidney A. Heenan, Park Ridge, all of Ill.

[73] Assignee: Amerace Corporation, Hackettstown, N.J.

[21] Appl. No.: 928,899

[22] Filed: Nov. 10, 1986

Related U.S. Application Data

[63] Continuation-in-part of Ser. No. 727,543, Apr. 6, 1986, abandoned.

[51] Int. Cl.[4] ..... E01F 9/00

[52] U.S. Cl. ..... 404/10; 173/132; 175/19; 248/417

[58] Field of Search ..... 404/10; 248/158, 160, 248/417, 916; 40/608, 612; 173/90, 91, 132; 175/19

[56] References Cited

U.S. PATENT DOCUMENTS

| | | | |
|---|---|---|---|
| 4,270,873 | 6/1981 | Laehy et al. | 404/10 |
| 4,491,438 | 1/1985 | Berutti | 404/10 |
| 4,565,466 | 1/1986 | Daggs et al. | 404/10 |
| 4,636,109 | 1/1987 | Clausen et al. | 404/10 |

*Primary Examiner*—James A. Leppink
*Assistant Examiner*—Matthew Smith
*Attorney, Agent, or Firm*—David Teschner; Ronald A. Sandler; Jerry A. Schulman

[57] ABSTRACT

A self-righting roadway marker support for a flexible boundary or roadway marker has a hollow anchor sleeve sunk into a supporting surface, a mounting collar secured to said anchor sleeve, a pivot strut extending through and upward from the collar, a compressible coil spring to resiliently urge the strut into contact with the collar, and a spring stop which selectively limits the extent to which the coil spring may be compressed. An oblong, radiused or chamfered aperture formed in the collar cooperates with a spring-mounting eyebolt to prevent the strut from rotating when deflected. A tool is also disclosed for installing the marker support. The force required to deflect the support assembly is set to be less than the force that would destroy or permanently set or deform the boundary marker.

18 Claims, 15 Drawing Figures

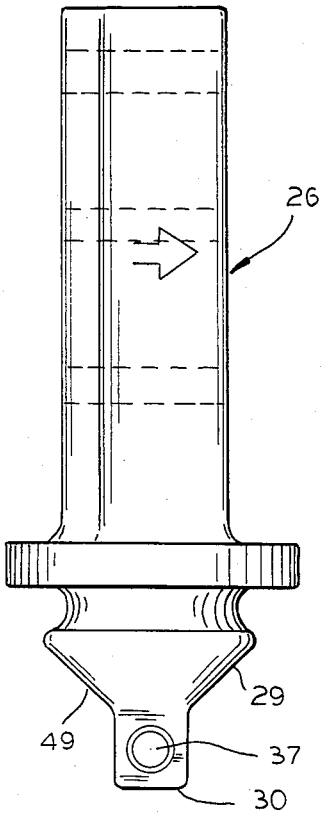
FIG.6
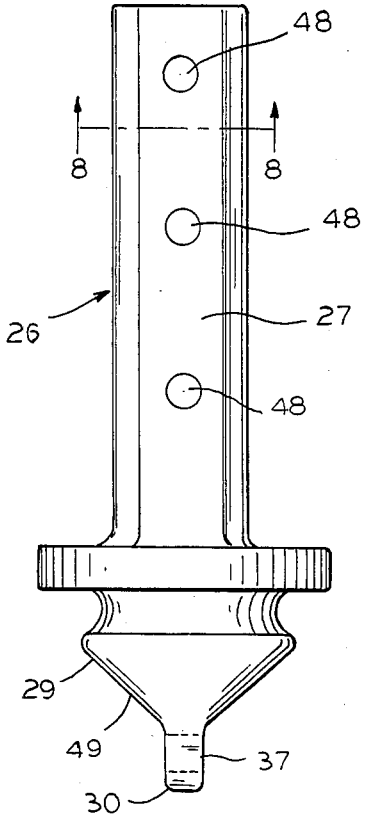
FIG.7
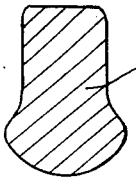
FIG.8
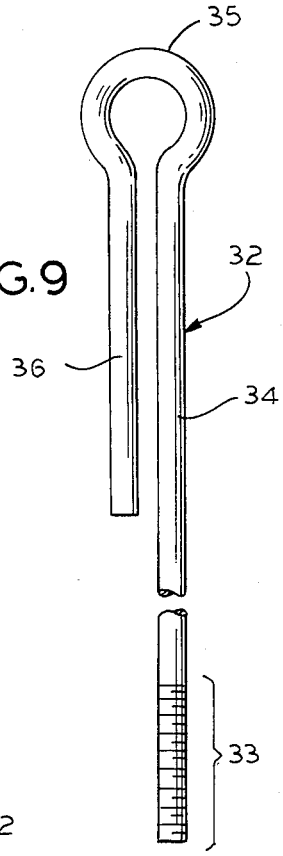
FIG.9
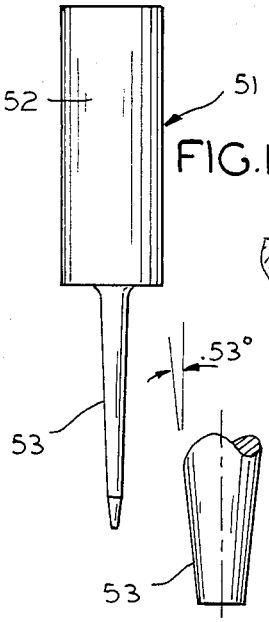
FIG.10
FIG.11
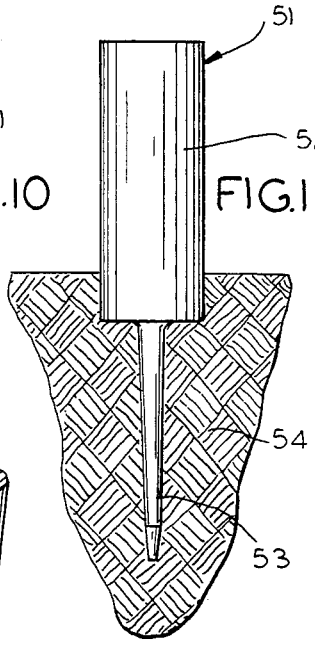
FIG.12
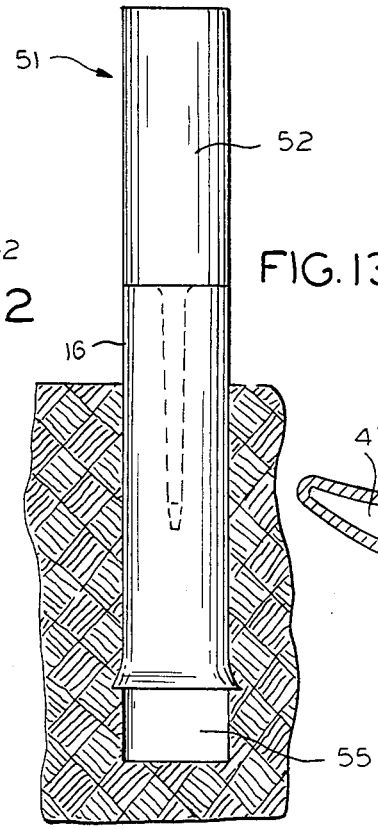
FIG.13
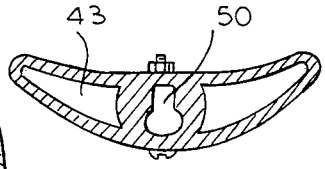
FIG.14

SELF-RIGHTING HIGHWAY MARKER SUPPORT AND METHOD FOR INSTALLING SAME

This is a continuation-in-part of our copending application Ser. No. 727,543, filed on Apr. 26, 1986 and since abandoned.

The present invention relates generally to supports for highway or roadway markers and, in particular, to a marker support which deflects upon impact from a vehicle and, thereafter, rights itself. Also disclosed is a method for installing the marker support.

BACKGROUND OF THE INVENTION

Use of ground-mounted highway and border markers is commonplace, as is use of systems and structures to allow such markers to survive impacts from vehicles while preserving the structural integrity and efficacy of the marker and minimizing the impact damage to the vehicle.

The type of marker being generally described is one that is mounted to a supporting surface (most commonly the ground, or the surface of a road or highway) and which extends above the ground to make the marker easily visible. Such visibility carries with it the considerable risk that, at one time or another, the marker will be struck by careless or inattentive drivers. Replacing each such marker as it is struck and broken represents a considerable expense in both manpower and material.

Accordingly, a number of systems have been proposed to protect the marker, or enable it to absorb such impacts, while also protecting the impacting body or vehicle. One such system involves the use of a marker having an easily sheared section which allows the marker to break easily under a relatively light impact. Such a solution requires frequent and immediate replacement of such markers, a situation which is manifestly unsuitable and dangerous where the markers involved were intended to mark off a highway or roadway boundary or hazard.

Exemplary of prior art efforts to provide a pivot which allows the marker post to yield to the force of impact and regain its upright orientation is U.S. Pat. No. 4,270,873, issued to Laehy, et al. Laehy teaches a two-piece telescoping tube construction having an internally disposed spring in the lowermost tube attached to an eye bolt supported by an anchor block in the uppermost tube. The two tubes pivot with respect to each other at the point where the upper spring tang is attached to the eye bolt.

In U.S. Pat. No. 1,282,673, issued to Brakery a deflectable sign post is shown having a coil spring element contained within the post itself with the lowermost portion of the spring anchored to a housing attached at ground level to a mounting plate.

U.S. Pat. No. 1,284,376, issued to Lehman, teaches a traffic indicator having an arcuate bottom tangentially meeting an arcuate upper surface of a base, with a spring disposed between the indicator and the base.

U.S. Pat. No. 1,679,623, issued to Olsen, teaches a signal post having a spring disposed in a below-the-ground tube attached at a hinge point to an upper post.

British Pat. No. 873,559, issued to Fraikin exemplifies a yieldable post having a spring element disposed within the post anchored at ground level, the compressive force of which holds the post in an upright position and returns the post to an upright position after it has been deflected.

BRIEF DESCRIPTION OF THE INVENTION

A self-righting highway marker support has a hollow tubular anchor sleeve driven into the supporting surface, such as the ground or roadway surface. The anchor sleeve is preferably formed from a semi-rigid material such as polyvinyl chloride (PVC) piping. Such piping will flex in response to forces transmitted from impacts, thus preventing progressive compaction of the soil within which the anchor is mounted. Such progressive compaction would otherwise, in time, enlarge the hole within which the anchor was seated, and would eventually loosen the anchor sleeve. A hinge strut has, at its lowermost end, a lower extension tongue terminating in a mounting site for an eye bolt. The tongue and the eye bolt are inserted into a collar having an upper, annular segment, and a lower, serrated segment. A coil spring is disposed about the eye bolt with the upper end of the spring abutting the lower surface of the upper collar segment and with the lowermost portion of the spring retained by retaining washers and a retaining nut threadably received by the eye bolt. A cylindrical tubular spring stop is disposed within the coil spring, about the eye bolt, and acts to prevent full compression of the coil spring by contacting the collar and the retaining washers as the spring is compressed. The retaining nut may be tightened to impart a desired compresive force to the spring, thereby altering the force with which the upper collar segment of the mounting collar abuts a flange formed integrally on the hinge strut. Once thus assembled, the lowermost serrated collar segment is driven into the anchor sleeve and is there mechanically retained by the contact of the serrations with the inside wall of the anchor sleeve, and, if desired, by the application of a PVC adhesive.

The hinge strut terminates at its upper end in an upper extension blade which affords mounting sites for a flexible roadway marker.

An installing tool is also provided which, when pneumatically driven into the mounting surface, forms a cylindrical hole within which the anchor sleeve may be disposed. The tool is first driven into the mounting surface to create the hole, and is then inserted into the mounting sleeve to drive the mounting sleeve into the hole. Thereafter, the collar may be inserted into the anchor sleeve, completing installation of the support.

In a preferred embodiment, a radiused or chamfered oblong or oval slot is formed in the bottom of the collar and the eye bolt includes a pair of side-by-side wire segments which extend through the slot. The wire segments are spaced far enough apart to allow them to be passed through the slot only along the longest, or major, axis or dimension of the slot. In this manner, the hinge strut maintains a selected orientation when it returns to its at-rest position regardless of the direction from which a deflecting force is applied to the roadway marker.

In like fashion, the upper extension blade of the hinge strut is formed with a non-circular cross-sectional configuration, and the roadway marker to be affixed thereto has a similarly shaped cavity extending axially therewithin. The combination of the eye bolt and collar slot, and the upper extension blade and roadway marker cross-sectional configurations acts to keep the roadway marker facing in a selected direction.

Thus, reflective elements mounted on the roadway marker will point in the same direction after the marker has been deflected and returned to its upright position, preserving the optimum reflective characteristics of the reflectors mounted on the roadway marker.

The pivoting action of the hinge strut with respect to the collar occurs at the contact of the hinge strut support flange on the uppermost surface of the upper collar segment.

These and further aspects of the present invention will become more apparent upon consideration of the accompanying drawings.

BRIEF DESCRIPTION OF THE DRAWINGS

FIG. 6 is a lateral view of the hinge strut;

FIG. 7 is a view of the hinge strut in FIG. 6 rotated through 90°;

FIG. 8 is a view along 8—8 of FIG. 7;

FIG. 9 is an elevation of the eye bolt;

FIG. 10 is a lateral elevation of the installing tool;

FIG. 11 is a detail of the tip of the installing tool of FIG. 10;

FIG. 12 is an elevation showing use of the installing tool to form the mounting hole for the anchor sleeve;

FIG. 13 is an elevation showing installing of the anchor sleeve;

FIG. 14 is a cross-sectional view of the highway marker as installed on the upper extension blade.

DETAILED DESCRIPTION OF THE DRAWINGS

Figure 1:
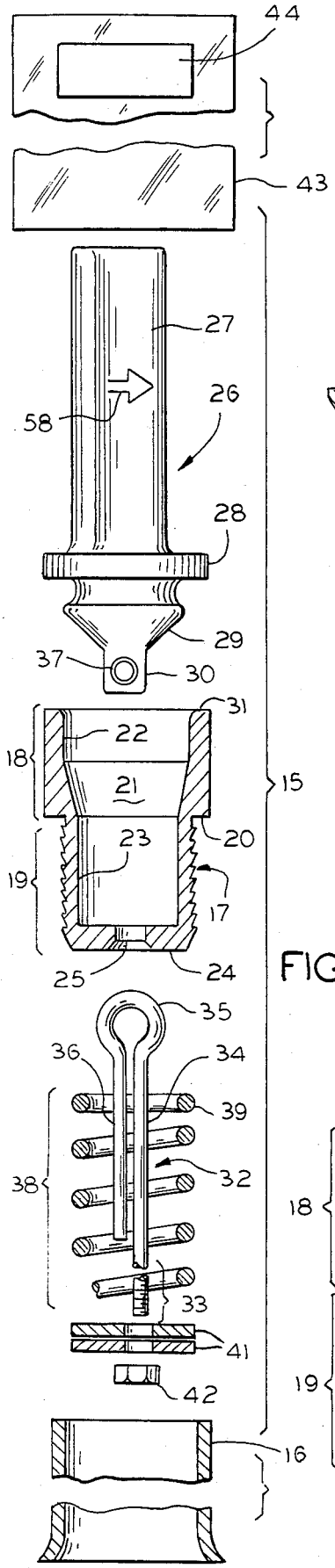
FIG. 1 is an exploded view illustrating the arrangement of the individual elements of a preferred embodiment of the present invention.

Referring now to FIG. 1, the numeral 15 indicates generally a preferred embodiment of the boundary marker support assembly of the present invention in exploded form. Anchor sleeve 16, formed preferably from a length of polyvinyl chloride (PVC) piping is installed in the supporting surface in a manner to be described more fully hereinbelow. Collar 17 includes an upper collar segment 18 and a lower collar segment 19. Upper and lower segments 18 and 19 are formed as a single integral casting, with upper segment 18 having a larger outside diameter than lower segment 19, thus forming land 20. A first collar passage 21 is defined by the contiguous inner wall segments 22 of upper segment 18 and 23 of upper segment 19. Collar 17 is closed off by collar bottom 24 through which a second passage 25 is formed.

Figure 2:
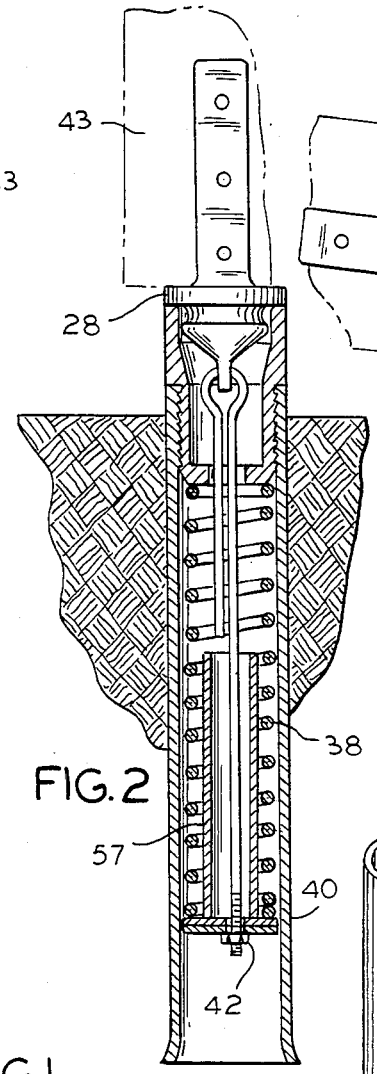
FIG. 2 is a side sectional view illustrating the embodiment of FIG. 1, including a spring stop, as installed in a supporting surface.

Hinge strut 26 is formed as a single intregal casting having an upper extension blade 27, a support flange 28, and a lower strut extension 29 terminating in a tongue 30. Flange 28 has an outside diameter approximately equal to the outside diameter of upper collar segment 18, whereby, when assembled, flange 28 abuts the upper surface 31 of collar 17 as best seen in FIG. 2.

Figure 3:
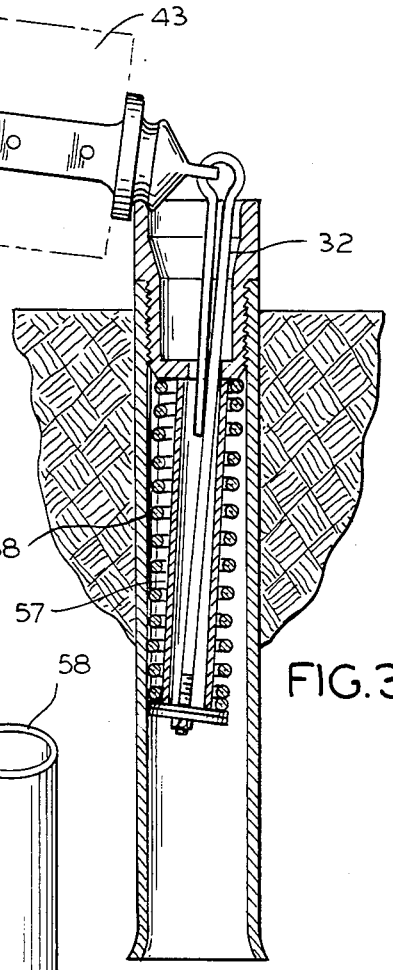
FIG. 3 is a view of the embodiment shown in FIG. 2 illustrating deflection of the hinge strut.

An eye bolt 32, best seen in elevation in FIG. 9, has a lower threaded shank portion 33 and a main shank portion 34 bent and configured to form a bright 35 and a parallel depending shank segment 36. Eye bolt 32 is sized and configured to enable depending shank segment 36 to be inserted through eye bolt aperture 37, formed on tongue 30 of pivot strut 26, as best seen in FIGS. 2 and 3.

A biasing element, herein preferably depicted as a coil spring 38 is arranged concentrically about eye bolt 32, with the uppermost coil 39 of spring 38 abutting bottom 24 of collar 17. The lowermost portion 40 of spring 38 is abutted by compression washers 41 secured in place by nut 42 which is threaded onto threaded portion 33 of eye bolt 32, as best shown in FIGS. 2 and 3.

Highway marker 43, shown in cross-section in FIG. 14, is affixed, by threaded fasteners, or by other conventional fastening elements to upper blade 27 of pivot strut 26. In the preferred embodiment herein discussed, cube-corner type reflecting elements, such as that depicted at 44 are attached to marker 43 and are oriented toward oncoming vehicular traffic in a manner to be more fully described hereinbelow.

Figure 5:
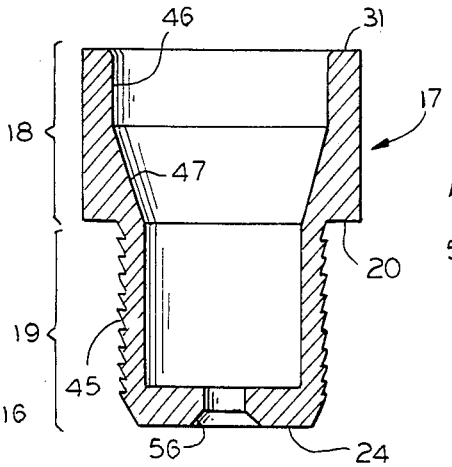
FIG. 5 is a view along 5—5 of FIG. 4.
Figure 4:
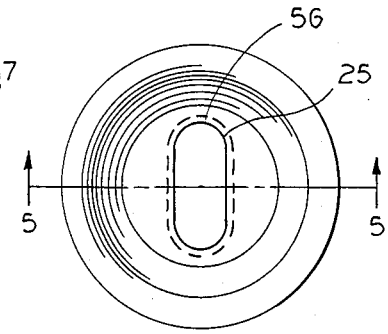
FIG. 4 is a top view of the collar shown in FIG. 1.

Referring now to FIGS. 4 and 5, various views of collar 17 are therein shown. In particular, FIG. 4 illustrates the substantially oval or oblong shape of slot 25, and the radius or chamfer 56 formed about the periphery of slot 25. FIG. 5 depicts land 20, upper bearing surface 31, and bottom 24 of collar 17 and also shows radius 56 in section. Lower collar segment 19 has formed on the exterior thereof a series of serrations 45 intended to create a mechanical grip or frictional engagement between collar 17 and anchoring sleeve 16 when collar 17 is driven therein.

As seen in FIG. 5, the interior of upper collar segment 18 is formed as a first generally vertically depending segment 46 and a second, tapering segment 47 contiguous with upper inner segment 46.

Referring now to FIGS. 6 and 7, front and lateral views of hinge strut 26 are therein shown. As seen in FIG. 7, a series of mounting ports 48 are included thereon to enable the attachment of boundary marker 43 to upper blade 27.

Also as seen in FIGS. 6 and 7, tongue 30 of hinge strut 26 has eye bolt aperture 37 formed therethrough. In addition, lower extension 29 of hinge strut 26 is tapered, as at 49, to somewhat generally conform to the taper of inner wall segment 47 of collar 17.

FIG. 8, a view along 8—8 of FIG. 7 illustrates the non-circular cross-sectional configuration of tongue 27, a configuration which has been selected for reasons which will appear more fully hereinbelow.

Referring now to FIGS. 4 and 9, and to FIGS. 2 and 3, it should be noted that when boundary marker support 15 is assembled, and eye bolt 34 has been installed through eye bolt aperture 37 of tongue 30, both ascending segment 34 and depending segment 36 of eye bolt 32 pass through slot 25 of collar 17. Because slot 25 is oval or oblong in shape, once eye bolt 32 is inserted through slot 25, it cannot rotate. In like fashion, it can be seen that bight 35, when positioned within eye bolt aperture 37 prevents the twisting or rotation of hinge strut 26 with respect to collar 17. This cooperation between tongue 30, eye bolt 32, and slot 25 maintains boundary marker 43 in a single, desired orientation, thus aligning reflective element 44 in a desired direction with respect to vehicular traffic. To more fully insure that boundary marker 43 maintains its alignment, as shown in FIG. 14, boundary marker 43 is formed with an internal, axially extending cavity 50, corresponding in cross-sectional shape and size to the cross-sectional configuration of pivot strut blade 27 as seen in FIG. 8.

FIG. 2 illustrates the boundary marker support of the present invention at rest. Lock nut 42 has been tightened along threaded portion 33 of eye bolt 32 to compress spring 38 to a desired degree of compression whereby the force with which flange 28 abuts upper collar surface 31 may be selected.

Figure 15:
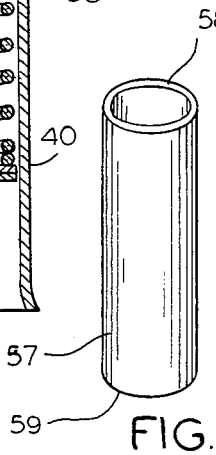
FIG. 15 is a perspective view of the spring stop shown in FIGS. 2 and 3.

A spring stop 57, as best seen in FIG. 15, is positioned coaxially with eye bolt 32 and within coil spring 38. Spring stop 57 is preferably formed as a rigid hollow cylinder, with an upper end 58 and a lower end 59, and is shorter in length than in coil spring 38. When the boundary marker support is at rest, a lower end 59 of spring stop 57 rests upon retaining washers 41.

As shown in FIG. 3, when boundary marker 43 is impacted as, for example, by a vehicle, lower extension 29 of pivot strut 26 bears upon upper surface 31 of collar 17, thereby drawing eye bolt 32 upward and compressing spring 38. Spring stop 57 will limit the compression of coil spring 38 when upper end 58 contacts bottom 24 of collar 17 while, at the same time, lower end 59 remains in contact with retaining washers 41. When the impacting force has ceased, the natural tendency of spring 38 to return to its original unstressed position draws eye bolt 32 downward through eye bolt slot 25 and, concurrently, draws pivot strut 26 downward to fully abut flange 28 with upper surface 31 of collar 17, thereby regaining the at-rest position shown in FIG. 2.

Referring now to FIGS. 10–13, in FIG. 10 there is shown a lateral elevation of a tool 51 intended to be used to install support 15. Tool 51 has an upper, cylindrical body portion 52 and a lower, cylindrical pilot 53. As shown in FIG. 11, pilot 53 has a taper along its length of 0.53°.

As shown in FIG. 12, pilot 53 is tapped into a supporting surface, such as an earthen shoulder herein typified by 54. At that point, using a hydraulically operated hammering tool, installation tool 51 is driven into surface 54 until a sufficient pre-selected depth for the installation of support 15 has been reached. Tool 51 is then withdrawn leaving behind a hole 55.

Thereafter, as seen in FIG. 13, anchor sleeve 16 is driven into hole 55 by placing tool 51 to abut the open upper end of anchor tube 16. Utilizing the same hydraulic hammering tool, anchor sleeve 16 is driven into hole 55 until it is flush with mounting surface 54. The completed support assembly may then be inserted and tapped or otherwise driven into support sleeve 16 until serrations 45 on lower collar segment 19 engage the inner walls of anchor sleeve 16. An epoxy cement may also be used to effect a more secure mechanical seal between lower collar segment 19 and anchor sleeve 16.

Use of tool 51 makes possible the facile and rapid construction and installation of assembly 15. It is contemplated that a number of said supports may be installed and, thereafter, road markers 43 may be attached thereto.

As seen in FIG. 1, an indicating arrow 58 may be cast directly onto pivot strut 26 indicating the direction in which said strut should be oriented in order to effect placement of boundary marker 43 and reflective element 44 along a desired line of sight.

In the embodiment herein presented, hinge strut 26 and collar 17 are preferably formed from 6045-12 ductile iron. Eye bolt 32 is preferably formed from SAE 1050 MB wire, marker 43 is formed as an extruded section of low density polyethylene, and is approximately four feet high and 3.5 inches wide. Spring 39 has a rate of 140 lbs/in.

Anchor sleeve 16 is formed from Schedule 120 PVC piping with a nominal diameter of 1½ inches. PVC is a semi-rigid substance and it has been found that use of such material as the anchor sleeve reduces the soil compaction which can occur as a result of repeated impacts to the marker assembly. It is believed that the PVC sleeve flexes proximate its upper end, thus absorbing the force from said impacts rather than transmitting the attendant shock forces along the entire length of the anchor sleeve. Prior to positioning, one end of anchor sleeve 16 is preferably heated to about 300° F., clamped shut, and allowed to cool. Thus configured, the closed end is effective in keeping loose dirt out of anchor sleeve 16 as it is driven into hole 55.

It is contemplated that collar 17 may be driven into anchor sleeve 16 by use of a conventional handheld hammer.

When assembled, marker assembly 15 provides a dual shock-absorbing action. Blows which are insufficient in force to deflect hinge strut 26 will be absorbed by the flexing of extruded marker 43; more severe blows will be absorbed by the previously-described cooperation of hinge strut 26, collar 17, and spring 39. Preferably, the compaction of spring 38 is selected such that the hinge assembly will deflect prior to the application of sufficient force on the flexible highway marker to destroy or deform the marker, thus providing a dual form of protection to marker 43. In either case, marker 43 will be repositioned, after impact, to its original orientation.

Use of spring stop 57 prolongs the useful life of coil spring 38 by preventing its full compression during the deflection of hinge strut 26. The degree to which compression is to be limited may be altered by, in this preferenced embodiment, changing the length of spring stop 57. Although spring stop 57 has herein been characterized as a hollow cylinder, it should be noted that other means for limiting compression would achieve the same result. As an example, a restraining strap may be secured to nut 42 while the other end may be secured to anchor sleeve 16.

Forming radius or chamfer 56 around slot 25 acts to lessen the bending movement applied to eye bolt 32 as it is drawn upward through slot 25 during deflection, and also helps to provide a smooth return to the at-rest position.

While the foregoing has been described in terms of a preferred embodiment of the present invention, it is to be understood that said description has been presented by way of example only. It is expected that others will perceive variations which, while differing from the foregoing, do not depart from the spirit and scope of the invention as herein described and claimed.

What is claimed is:

1. A self-righting boundary marker for relatively permanent installation into an associated supporting surface, said marker comprising:

a tubular anchor sleeve adapted to be embedded substantially within said associated supporting surface;

a support collar having contiguous upper and lower segments, said support collar having contiguous upper and lower axially extending passageways formed therethrough;

means for firmly securing said lower collar segment within said anchor sleeve;

a hinge strut having an upper extension, a lower extension, and an annular support flange formed integrally thereon intermediate said upper and lower extensions, said flange being sized and shaped to abut said upper collar segment when said lower strut extension is inserted into said collar via said upper passageway, said collar allowing pivotal deflection of said hinge strut from an at-rest position with respect to said collar responsive to a deflecting force applied to said hinge strut;

boundary marker means carried by said hinge strut upper extension;

means for resiliently returning said hinge strut to said at-rest position when said deflecting force terminates, said resilient return means including a connector attached to and extending from said lower hinge strut extension and passing through said lower support collar passageway; and means for aligning said upper hinge strut extension in a preselectable direction and for causing said hinge strut to return to face in said preselected direction when said hinge is deflected and returned to said at-rest position, said aligning means substantially preventing rotational movement of said hinge strut during the deflection of said strut, said aligning means further including forming said lower collar passageway in an oval or oblong shape having a major or larger dimension and a smaller or minor dimension, and shaping and sizing said connector to pass through said lower collar passageway along said major or larger but not said minor or smaller dimension, thereby substantially precluding rotation of said hinge strut while permitting deflection thereof in any direction.

2. The apparatus as recited in claim 1, wherein said resilient return means includes means for applying a biasing force to urge said flange into contact within said upper collar segment, and said biasing force is selected to enable said hinge strut to deflect responsive to an impact force less than that required to permanently deform or destroy said boundary marker.

3. The apparatus as recited in claim 1 wherein said connector is an eye bolt having first and second ends, said first end being attached to said lower hinge strut extension;

said resilient return means including a coil spring disposed concentrically about said eye bolt intermediate said collar flange and said second eye bolt end, said resilient return means further including means for retaining said coil spring at said second eye bolt end, said first and second eye bolt ends cooperating with said lower segment to provide said aligning means.

4. The apparatus as recited in claim 3 wherein said resilient return means further includes means the limit to compression of said coil spring when said hinge strut is deflected.

5. The apparatus as recited in claim 4 wherein said compression limiting means comprises a cylindrical tubular segment positioned within and coaxial with said coil spring.

6. The apparatus as recited in claim 5 wherein said eye bolt is passed through said cylindrical tubular segment.

7. The apparatus as recited in claim 3 wherein said coil spring retaining means includes means for selectively compressing said coil spring to thereby alter the force with which said collar flange engages said upper collar segment.

8. The apparatus as recited in claim 1 wherein said anchor sleeve comprises a tubular segment of thermoplastic piping.

9. The apparatus as recited in claim 1 wherein said collar securing means includes a plurality of serration elements formed about the outer periphery of said lower collar segment to provide mechanical interengagement of said collar outer periphery with the inner surface of said anchor sleeve.

10. The apparatus as recited in claim 1 wherein said anchor sleeve and said lower collar segment are of generally identical cross-sectional configuration with the outside dimensions of said lower collar segment substantially identical to or slightly larger than the inside diameter of said anchor sleeve.

11. The apparatus as recited in claim 1 wherein said hinge strut further includes a tapered surface formed thereon intermediate said flange and said lower strut extension, said upper passageway in said collar being formed to generally conform to the shape of said tapered surface, said tapered surface being sized and shaped to generally align the interior of said collar with said upper passageway when said hinge strut is deflected and returns to said at-rest position.

12. The apparatus as recited in claim 1 wherein said at-rest position is substantially vertical, and said boundary marker is of a relatively flexible material.

13. The apparatus as recited in claim 1 wherein said lower collar segment includes a lowermost surface at which said lower collar passageway terminates, said lowermost surface being chamfered or radiused about the periphery of said lower collar passageway.

14. The apparatus as recited in claim 1 wherein said boundary marking means comprises a relatively flexible material having a different cross section than said tubular anchor sleeve.

15. The apparatus as recited in claim 3 wherein said eye bolt is formed with ascending and depending bolt segments defining said first and second ends, said segments being arranged in fixed, parallel, spatial relationship far enough apart to enable the passage of said segments through said lower collar passageway along said major or larger but not said minor or smaller dimension of said lower collar passageway.

16. Method for installing a roadway marker support into a supporting surface, said support of the type having a tubular anchor sleeve of generally uniform outside diameter, a support collar having a lower mounting extension with an outside diameter equal to or slightly greater than the inside diameter of said sleeve, and an upper extension having a uniform outside diameter equal to said outside sleeve diameter, said method comprising the steps of (a) fashioning a pilot tool having an outside diameter substantially equal to said outside sleeve diameter;

(b) driving said pilot tool into said mounting surface to compressibly displace the material of said surface to form a generally cylindrical passage;

(c) removing said pilot tool from said passage;

(d) aligning a first end of said sleeve with said passage;

(e) aligning said pilot tool with second end of said sleeve;

(f) impacting said pilot tool to drive said sleeve into said passage;

(g) removing said pilot tool from said sleeve; and (h) inserting said lower mounting extension into said sleeve.

17. The method of claim 16 wherein step (f) includes driving said sleeve into said passage until said second end of said sleeve is flush with said mounting surface.

18. The method of claim 16 wherein step (a) includes forming a tapering pilot extension integral with said tool of a diameter substantially less than said outside sleeve diameter.

* * * * *

UNITED STATES PATENT AND TRADEMARK OFFICE

CERTIFICATE OF CORRECTION

PATENT NO. : 4,729,690

DATED : March 8, 1988

INVENTOR(S) : Lavender et al.

It is certified that error appears in the above—identified patent and that said Letters Patent is hereby corrected as shown below:

In the Specification:

Col. 4, line 1, change "bright" to --bight--.

In the Claims:

Col. 7, line 57, change "the" to --to--.

line 58, change "to" to --the--.

Signed and Sealed this

Twenty-ninth Day of May, 1990

*Attest:*

HARRY F. MANBECK, JR.

*Attesting Officer*

*Commissioner of Patents and Trademarks*